US008347872B2

(12) United States Patent
Gobright, IV

(10) Patent No.: US 8,347,872 B2
(45) Date of Patent: Jan. 8, 2013

(54) BATTERY POWERED CONCRETE SAW SYSTEM

(76) Inventor: Francis M. Gobright, IV, Howell, MI (US)

( * ) Notice: Subject to any disclaimer, the term of this patent is extended or adjusted under 35 U.S.C. 154(b) by 352 days.

(21) Appl. No.: 12/713,293

(22) Filed: Feb. 26, 2010

(65) Prior Publication Data

US 2011/0209692 A1 Sep. 1, 2011

(51) Int. Cl.
*B28D 1/04* (2006.01)

(52) U.S. Cl. ..... 125/13.03; 125/12; 125/13.01; 451/350

(58) Field of Classification Search ..... 125/12–13.03
See application file for complete search history.

(56) References Cited

U.S. PATENT DOCUMENTS

| | | | | |
|---|---|---|---|---|
| 2,468,336 | A | 4/1949 | Lewis | |
| 4,120,411 | A * | 10/1978 | Johnson | 414/351 |
| 4,175,788 | A | 11/1979 | Jacobson et al. | |
| 4,630,837 | A * | 12/1986 | Kazmark | 280/47.2 |
| 4,767,162 | A | 8/1988 | Reed, III | |
| 4,824,516 | A | 4/1989 | Ishihara et al. | |
| 4,896,897 | A * | 1/1990 | Wilhelm | 280/655 |
| 4,998,775 | A | 3/1991 | Hollifield | |
| 5,104,195 | A | 4/1992 | Zaccho | |
| 5,531,630 | A * | 7/1996 | Crosta | 451/5 |
| 5,716,260 | A * | 2/1998 | Griffin et al. | 451/87 |
| 5,810,373 | A * | 9/1998 | Miranda | 280/47.2 |
| 5,810,448 | A | 9/1998 | Kingsley et al. | |
| 6,059,300 | A * | 5/2000 | Wu | 280/47.2 |
| 6,102,022 | A | 8/2000 | Schave | |
| 6,164,425 | A * | 12/2000 | Latshaw | 190/18 A |
| 6,484,711 | B2 | 11/2002 | Acker et al. | |
| 6,530,821 | B2 * | 3/2003 | Legatt et al. | 451/8 |
| 6,575,819 | B2 * | 6/2003 | Beyersdorff | 451/352 |
| 7,000,605 | B2 * | 2/2006 | Due | 125/13.01 |
| 7,942,142 | B2 * | 5/2011 | Gobright, IV | 125/13.01 |
| 8,084,993 | B1 * | 12/2011 | Wong | 320/116 |
| 2002/0117160 | A1 | 8/2002 | Acker et al. | |
| 2003/0168054 | A1 | 9/2003 | Governo et al. | |
| 2005/0110461 | A1 * | 5/2005 | McConnell et al. | 320/116 |
| 2006/0028177 | A1 * | 2/2006 | Ferro et al. | 320/114 |
| 2007/0164598 | A1 | 7/2007 | Johnson et al. | |
| 2009/0107476 | A1 | 4/2009 | Gobright, IV | |

* cited by examiner

*Primary Examiner* — George Nguyen
(74) *Attorney, Agent, or Firm* — Brooks Kushman P.C.

(57) ABSTRACT

A battery operated concrete saw system (10) includes an electric saw (12) and a battery pack cart (14) as well as an electrical cord (62) for facilitating cutting in small places with a battery pack cart at a remote location.

1 Claim, 2 Drawing Sheets

BATTERY POWERED CONCRETE SAW SYSTEM

BACKGROUND OF THE INVENTION

1. Field of the Invention

This invention relates to a battery powered concrete saw system for cutting concrete, asphalt and the like, etc.

2. Background Art

Saws for cutting concrete, asphalt and the like, etc. are conventionally electrically powered or powered by an internal combustion engine that utilizes gasoline or diesel fuel, the latter of which cannot be used indoors due to the exhaust generated. When concrete saws are powered by electricity, an electric motor of at least 5 horsepower is needed and an internal combustion engine generator is conventionally used to provide the necessary power because the necessary power is usually not conveniently located to the cutting location. However, when indoor cutting is required, the generator due to its exhaust must be operated outside and the time required to run an electrical line, which often is hundreds of feet and/or up a number of stories, can be prohibitedly expensive and also results in resistance power loss in the electrical line.

U.S. Pat. No. 7,000,605 Due discloses a concrete engraver apparatus and method that is normally operated through a power cord that appears in the drawings to be house type 110 volt, but is also disclosed as using a battery pack.

This engraver is manually moved much like a carpet vacuum cleaner and does not appear to be sufficiently heavy duty to permit use in heavy duty concrete cutting jobs.

U.S. Pat. No. 4,998,775 Hollifield discloses an apparatus for precision cutting of concrete surfaces that utilizes a battery for powering a self-powered vehicle supported by a pair of spaced tracks. The necessity for spaced tracks for such a concrete cutter would result in any cutting job also being prohibitedly expensive.

Other prior art noted during an investigation conducted for the present invention include U.S. Pat. No. 2,468,336 Lewis; U.S. Pat. No. 4,175,788 Jacobson et al.; U.S. Pat. No. 4,767,162 Reed, III; U.S. Pat. No. 4,824,516 Ishihara et al.; U.S. Pat. No. 5,104,195 Zaccho; U.S. Pat. No. 5,810,448 Kingsley et al.; U.S. Pat. No. 6,102,022 Schave; and U.S. Pat. No. 6,484,711 Acker et al; and also include United States Published Patent Applications: 2002/0117160 Acker et al; 2003/0168054 Governo et al; and 2007/0164598 Johnson et al.

SUMMARY OF THE INVENTION

An object of the present invention is to provide an improved concrete cutting saw system.

In carrying out the above object, a concrete cutting saw system constructed in accordance with the present invention includes a saw having a frame including a pair of rear wheels and at least one front wheel for facilitating movement of the saw to different locations for use and for movement during use performing a cutting operation. An electric motor of the saw is mounted by the frame, and a pair of saw arbors are respectively mounted on the frame for rotation on opposite lateral sides of the frame forward of the pair of rear wheels, and the saw arbors have a rotational connection to the electric motor to provide rotational driving thereof for cutting. An actuator of the saw is operable to move the front wheel upwardly and downwardly with respect to the frame to pivot the frame about the rear wheels between an upper idle position and a lower use position that permits cutting of concrete or the like with a saw blade mounted on one of the arbors. A cart of the saw system provides for support of a battery pack and includes wheels and a handle for moving the battery pack to adjacent a location at which a cutting operation is to be performed. An electrical cord of the system provides for electrical connection of the battery pack and the electric motor to power the saw for use which is facilitated in small spaces by the remote location of the battery pack cart from the saw.

The electrical cord of the saw system is no greater than fifty feet long, and as disclosed between 25 and 35 feet long. Also, the actuator of the saw system is disclosed as a hand crank. Furthermore, the saw includes a pair of front wheels moved upward and downwardly by the actuator and the pair of saw arbors are located forward of the pair of front wheels.

The saw system disclosed also includes a battery charger mounted by the cart and having another electrical cord for recharging the battery pack from an AC electrical outlet.

The electrical motor of the saw may be of the direct current type for powering the saw. The electrical motor of the saw may also be of the alternating current type, in which case the saw also includes an inverter for changing direct current from the battery pack to alternating current for powering the saw.

As disclosed, the saw system includes a battery pack having batteries that may be lithium based batteries, nickel based batteries, lead based batteries and combinations thereof.

The cart of the saw system disclosed has a lower support for the battery pack, an upwardly extending frame including an upper handle end, a pair of main wheels for moving the cart with the frame inclined by an operator holding the handle end of the frame, and auxiliary wheels that cooperate with the main wheels to support the cart with the frame inclined during movement.

The objects, features and advantages of the present invention are readily apparent from the following detailed description of the preferred embodiment when taken in connection with the accompanying drawings.

DETAILED DESCRIPTION OF THE PREFERRED EMBODIMENT

Figure 1:
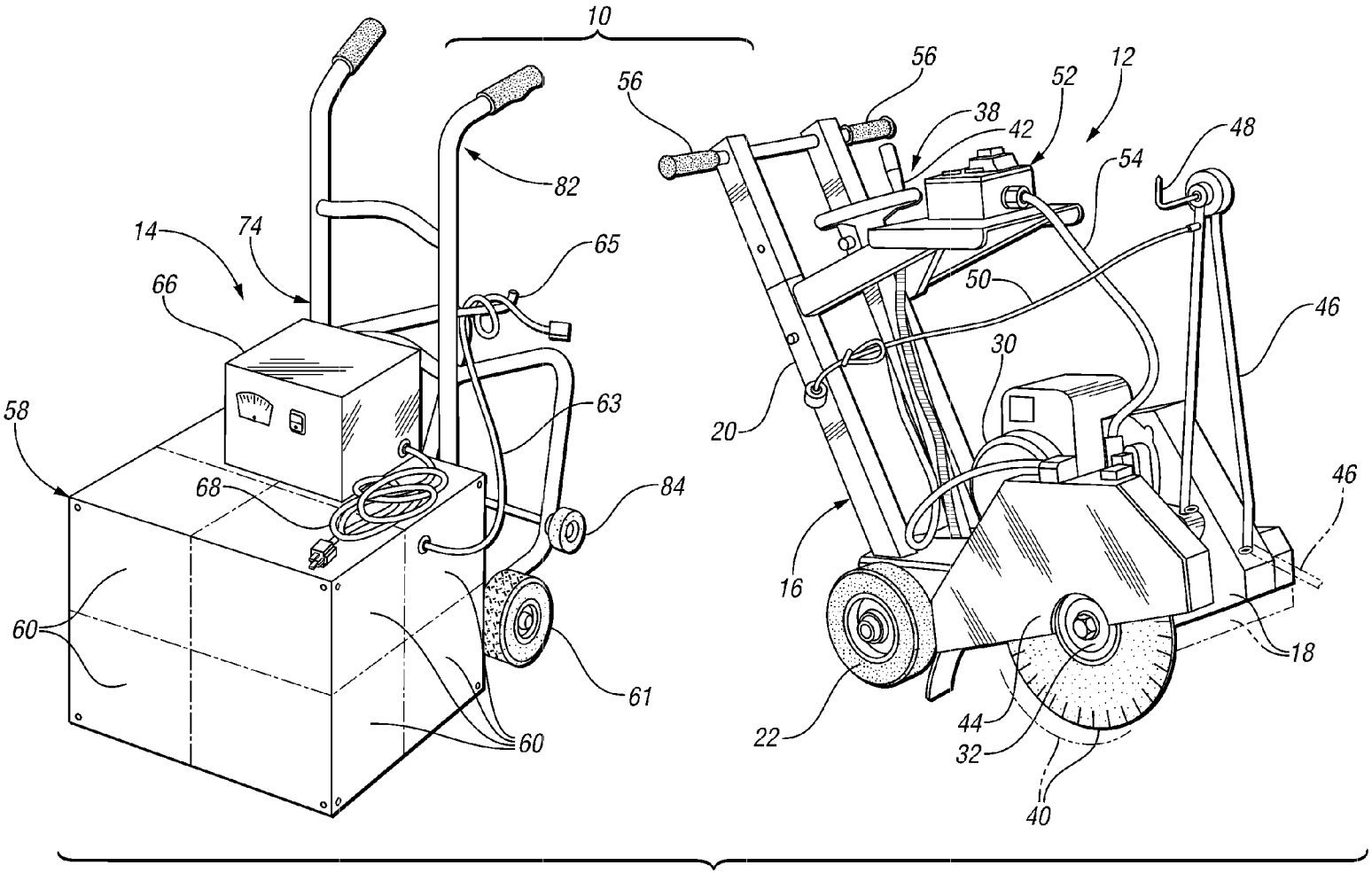
FIG. 1 is a perspective view of a battery operated concrete cutting saw system constructed in accordance with the present invention with an electric saw and a battery pack cart.

With reference to FIG. 1 of the drawing, a battery powered concrete cutting saw system collectively indicated by 10 includes an electric motor saw 12 and a battery pack cart 14 for powering the saw as is hereinafter more fully described.

Figure 2:
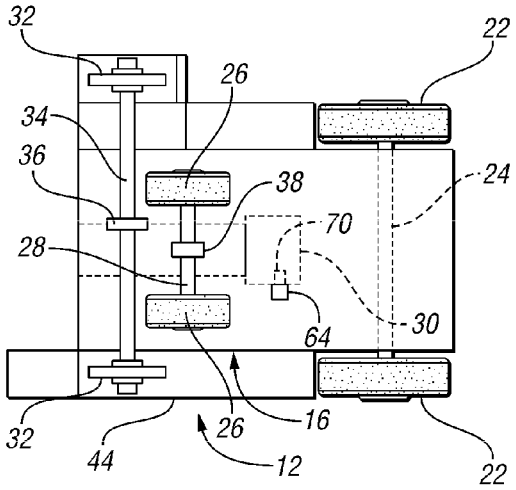
FIG. 2 is a schematic bottom plan view of the electric saw of the saw system

As shown in FIGS. 1 and 2, the saw 12 includes a frame 16 having a lower support portion 18 and a rearwardly inclined generally upright handle portion 20 shown in FIG. 1. The saw includes a pair of rear wheels 22 on a rear axle 24 and at least one front wheel 26; there are actually a pair of front wheels 26 on a front axle 28 as illustrated. The rear and front wheels 22 and 26 facilitate movement of the saw to different locations for use and for movement during use performing a cutting operation.

As shown in FIG. 1 and schematically in FIG. 2, an electric motor 30 is mounted by the saw frame 16. Furthermore, a pair of saw arbors 32 are respectively mounted on an arbor shaft 34 at opposite lateral sides of the frame forward of the pair of rear wheels 22. Any conventional type of rotational connection as schematically indicated by 36 in FIG. 2 connects the electric motor 30 to the saw arbors 32 through the arbor shaft 34 as shown to provide rotational driving of the saw arbors; for example sprockets and a chain can embody the rotational connection.

As shown in FIG. 1, the saw 12 also includes an actuator 38 connected to the front wheel axle 28 to move each front wheel 26 upwardly and downwardly with respect to the frame 16 to pivot the frame about the rear wheels 22 between an upper idle position shown in FIG. 1 by solid line representation and a lower use position shown partially by phantom line representation to permit cutting of concrete or the like with a saw blade 40 mounted on one of the arbors. As illustrated, the actuator 38 is a hand crank 42 whose screw operation provides the raising and lowering of the saw arbors between the upper idle and lower use positions. While a power operated actuator can also be used, the manual hand crank is lighter and thus lends itself for use on a smaller more maneuverable saw used in small spaces.

As also shown in FIG. 1, a blade guard 44 is detachable mounted on either lateral side of the saw frame 16 to cover the saw blade 40 and is movable to the other lateral side when the blade is used at that side for cutting. In addition, a saw guide 46 is pivotally mounted on the support portion 18 of the saw frame 16 for movement between an upper idle position as shown by solid line representation and a lower use position as shown partially by phantom line representation. The saw guide 46 includes a pointer 16 that in the use position provides guiding of the saw along the cut line of the saw blade 40 being used. A suitable cord 50 or the like is provided to hold the guide 46 in its upper idle position when not being used. Also, a manually operable controller 52 on the upper handle portion 20 of frame 16 has a connection cord 54 to the electric motor 30 to facilitate motor control by an operator who moves the saw by the handles 56 at each lateral side of the upper end of the handle portion 20.

Figure 3:
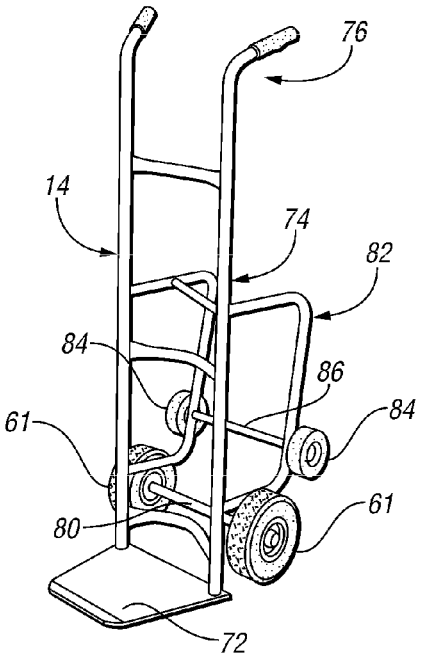
FIG. 3 is a perspective view of the battery pack cart of the saw system with the battery pack cart removed and showing the cart in an upright position.
Figure 4:
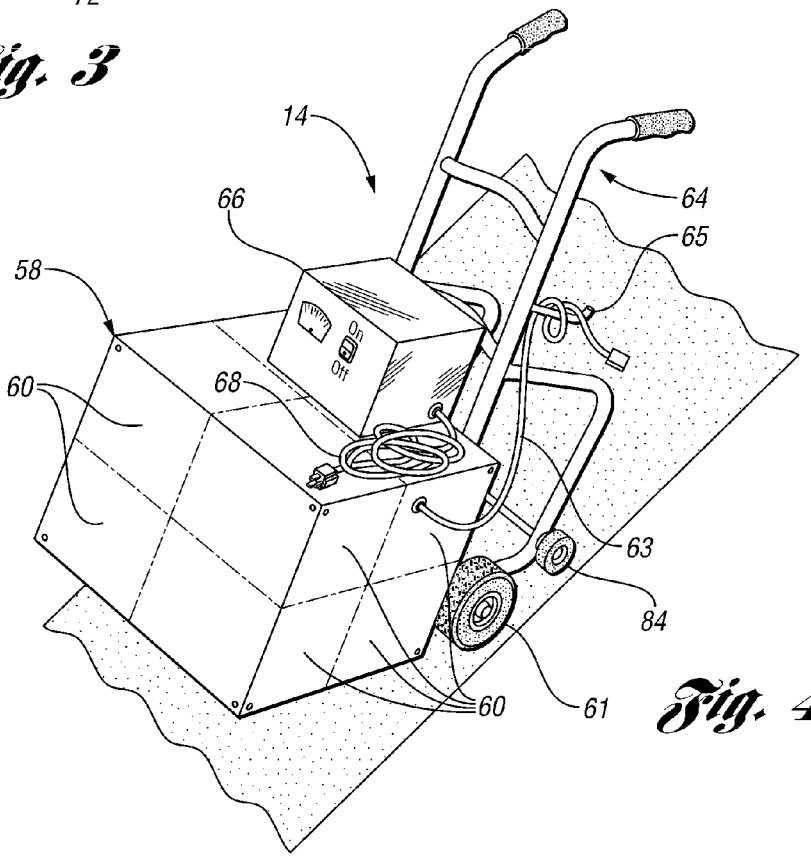
FIG. 4 is a perspective view of the battery pack cart in an inclined position for movement on main and auxiliary wheels.

As shown in FIGS. 1, 3 and 4, the battery pack cart 14 of the saw system provides support for a battery pack 58 which is shown as including a plurality of batteries 60. The cart 14 includes main wheels 61 and a handle end 62 for moving the battery pack to adjacent a location at which a cutting operation is to be performed. An electrical cord 63 functions to connect the battery pack 58 and the electric motor 30 of the cart through a schematically indicated electrical connection 64 (FIG. 2) to power the saw for use which is facilitated in small spaces by the remote location of the battery pack from the saw. The electrical cord 63 can be mounted on spring biased winding wheel, or with electrical connectors on both ends for connection to the electric motor and the battery pack and with storage in a coiled condition that can be hung on a battery pack hook or on the cart hook 65 shown.

The construction of the battery powered concrete saw system provides the necessary power indoors without the necessity for stringing an electrical power cord from an outside generator to a distant cutting location or up a number of floors. The electrical cord 63 utilized is no greater than 50 feet and preferably about 25 to 35 feet long with 30 feet being optimal to permit powering of the saw with sufficient cutting movement without excessive electrical resistance loses in the cord.

As shown in FIG. 2, the saw as previously mentioned includes a pair of front wheels 26 moved upwardly and downwardly by the actuator 38 and the pair of saw arbors 32 are located forward of the pair of front wheels 26.

As shown in FIG. 1, the saw system also includes a battery charger 66 mounted by the cart 14 and having another electrical cord 68 for recharging the battery pack 58 from an AC electrical outlet.

The electrical motor 30 is preferably of about 5 to 15 horsepower and most preferably about 10 horsepower. Also, the electric motor 30 may be of the direct current type for powering the saw or may be of the alternating current type in which case the saw further includes an inverter 70 (FIG. 2) for changing the direct current from the battery pack 58 to alternating current. The inverter may also provide 3 phase electrical power which provides enhanced performance. In one embodiment, the battery pack has 24 batteries of about 3.3 volts each connected in series to provide a total voltage of about 80 volts powering the saw. More batteries connected in series can also be used to provide greater voltage and more cutting horsepower. Furthermore, as battery development proceeds, the battery size and weight may permit the use of more batteries and the resultant increase in voltage and cutting horsepower without an increase in the size and weight of the battery pack.

The type of batteries 60 used in the battery pack 58 may be lithium based batteries, nickel based batteries, lead based batteries or combinations of such batteries.

As shown in FIG. 3, the battery pack cart 14 includes a lower support 72 for supporting the battery pack and an upwardly extending frame 74 having the upper handle end 62 for manual operation of the cart. The pair of main wheels 61 on a lower axle 80 allow the cart to be tipped for movement and an auxiliary frame 82 supports a pair of auxiliary wheels 84 on an auxiliary axle 86 such that the auxiliary wheels cooperate with the main wheels to support the cart as shown in FIG. 4 with the frame inclined during movement.

The battery pack includes a suitable housing or framework for connecting the batteries and having suitable connections to the cart support 72 and/or the cart frame 74 to secure the battery pack during cart movement. Likewise, the battery charger 66 has a suitable connection to the battery pack 58 and/or the cart so as to be secure during cart movement.

While an embodiment of the invention has been illustrated and described, it is not intended that this embodiment illustrates and describes all possible forms of the invention. Rather, the words used in the specification are words of description rather than limitation, and it is understood that various changes may be made without departing from the spirit and scope of the invention.

What is claimed is:

1. A battery power concrete saw system comprising:

a saw including a frame having a pair of rear wheels and a pair of front wheels for facilitating movement of the saw to different locations for use and for movement during use performing a cutting operation;

an alternating current electric motor mounted by the frame;

a pair of saw arbors respectively mounted on the frame for rotation on opposite lateral sides of the frame forward of the pair of front wheels, and the saw arbors having a rotational connection to the electric motor to provide rotational driving thereof;

an actuator for moving the front wheels upwardly and downwardly with respect to the frame to pivot the frame about the rear wheels between an upper idle position and a lower use position that permits cutting of concrete with a saw blade mounted on one of the arbors;

a cart including a lower support for mounting a lithium based battery pack having a plurality of batteries connected in series to provide at least 80 volts for powering the saw, an upwardly extending frame including an upper handle end, and a pair of wheels for moving the cart with the frame inclined by an operator holding the handle end of the frame;

an inverter;

an electrical cord for connecting the lithium based battery pack and the alternating current electric motor through the inverter to power the saw for use which is facilitated in small spaces by the remote location of the battery pack from the saw; and a battery charger mounted by the cart and having another electrical cord for recharging the battery pack from an AC electrical outlet.

* * * * *